US008660917B2

(12) United States Patent
Menezes et al.

(10) Patent No.: US 8,660,917 B2
(45) Date of Patent: Feb. 25, 2014

(54) MULTIPOINT BILLING QUALITY CONTROL AND CERTIFICATION

(75) Inventors: Jerold P. Menezes, Irving, TX (US); Harish D. Korapati, Irving, TX (US); Velamur Srinivasan Sudharsan, Flower Mound, TX (US); Vivek Gurumurthy, Irving, TX (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 17 days.

(21) Appl. No.: 13/443,275

(22) Filed: Apr. 10, 2012

(65) Prior Publication Data

US 2013/0268419 A1 Oct. 10, 2013

(51) Int. Cl.
*G07B 17/00* (2006.01)
*G07F 19/00* (2006.01)

(52) U.S. Cl.
USPC ..... 705/30; 705/34

(58) Field of Classification Search
None
See application file for complete search history.

(56) References Cited

U.S. PATENT DOCUMENTS

2004/0067747 A1* 4/2004 Carpenter et al. ..... 455/405
2005/0031103 A1* 2/2005 Gunderman, Jr. ..... 379/114.03
2008/0275774 A1* 11/2008 Pepe et al. ..... 705/14

OTHER PUBLICATIONS

Integrated Statewide Record System (ISRS), Information Technology Services, 2006.*

* cited by examiner

*Primary Examiner* — Matthew Gart
*Assistant Examiner* — Michael Maicher

(57) ABSTRACT

A device is provided that includes a processor to: receive current billing information associated with an account of a customer; receive prior billing information associated with the account; compare the current billing information with the prior billing information; determine whether an inaccuracy exists in the current billing information based on the comparison; determine whether an inaccuracy exists in the current billing information due to improperly applied promotional information to the account; determine whether an inaccuracy exists in the current billing information due to an improperly applied set of rules to the account; correct, when one or more inaccuracies exist in the current billing information; the one or more inaccuracies; and create a final bill for the account based on the current billing information and the corrected one or more inaccuracies.

24 Claims, 7 Drawing Sheets

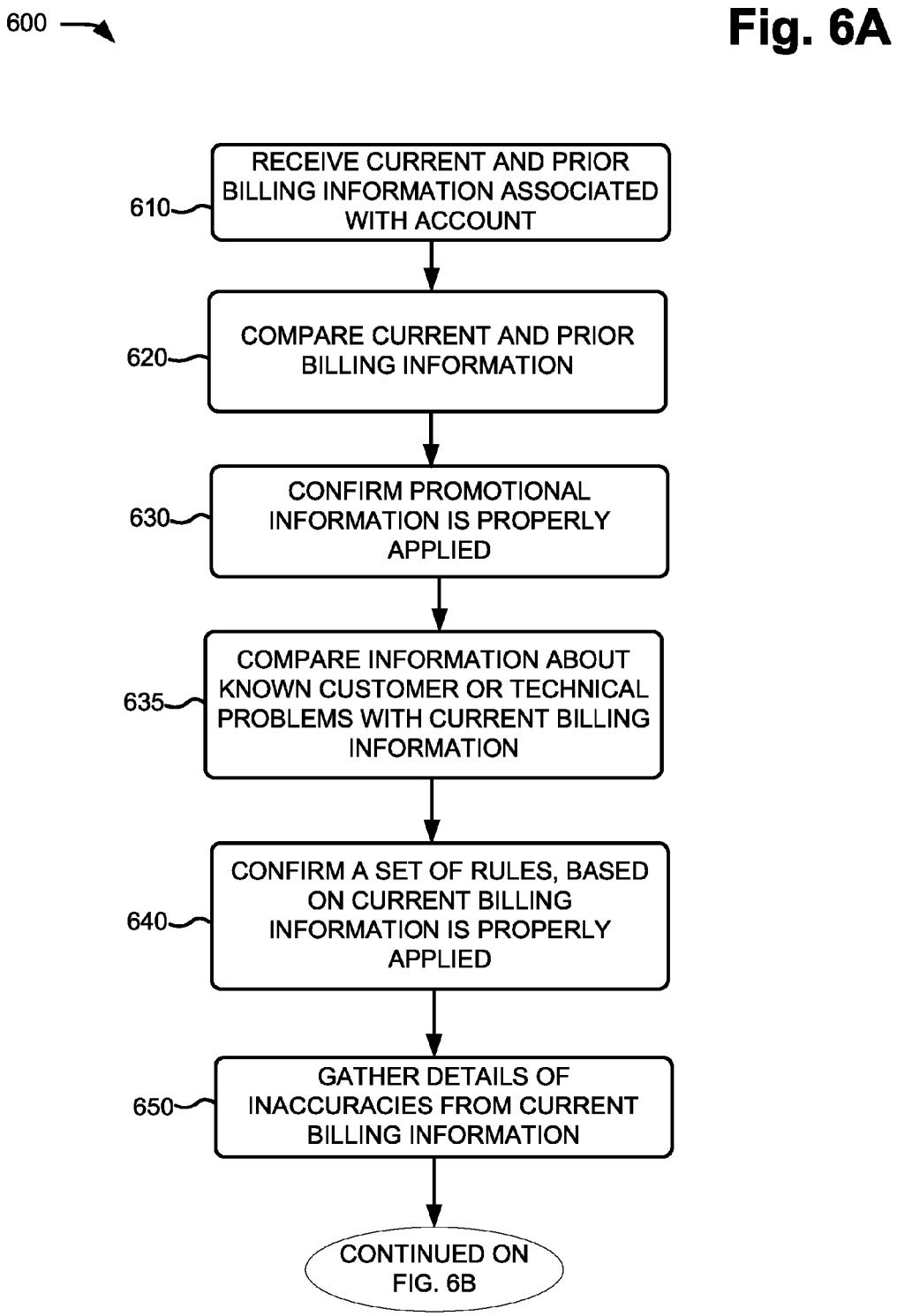
600
Fig. 6A
610
RECEIVE CURRENT AND PRIOR BILLING INFORMATION ASSOCIATED WITH ACCOUNT
620
COMPARE CURRENT AND PRIOR BILLING INFORMATION
630
CONFIRM PROMOTIONAL INFORMATION IS PROPERLY APPLIED
635
COMPARE INFORMATION ABOUT KNOWN CUSTOMER OR TECHNICAL PROBLEMS WITH CURRENT BILLING INFORMATION
640
CONFIRM A SET OF RULES, BASED ON CURRENT BILLING INFORMATION IS PROPERLY APPLIED
650
GATHER DETAILS OF INACCURACIES FROM CURRENT BILLING INFORMATION
CONTINUED ON FIG. 6B

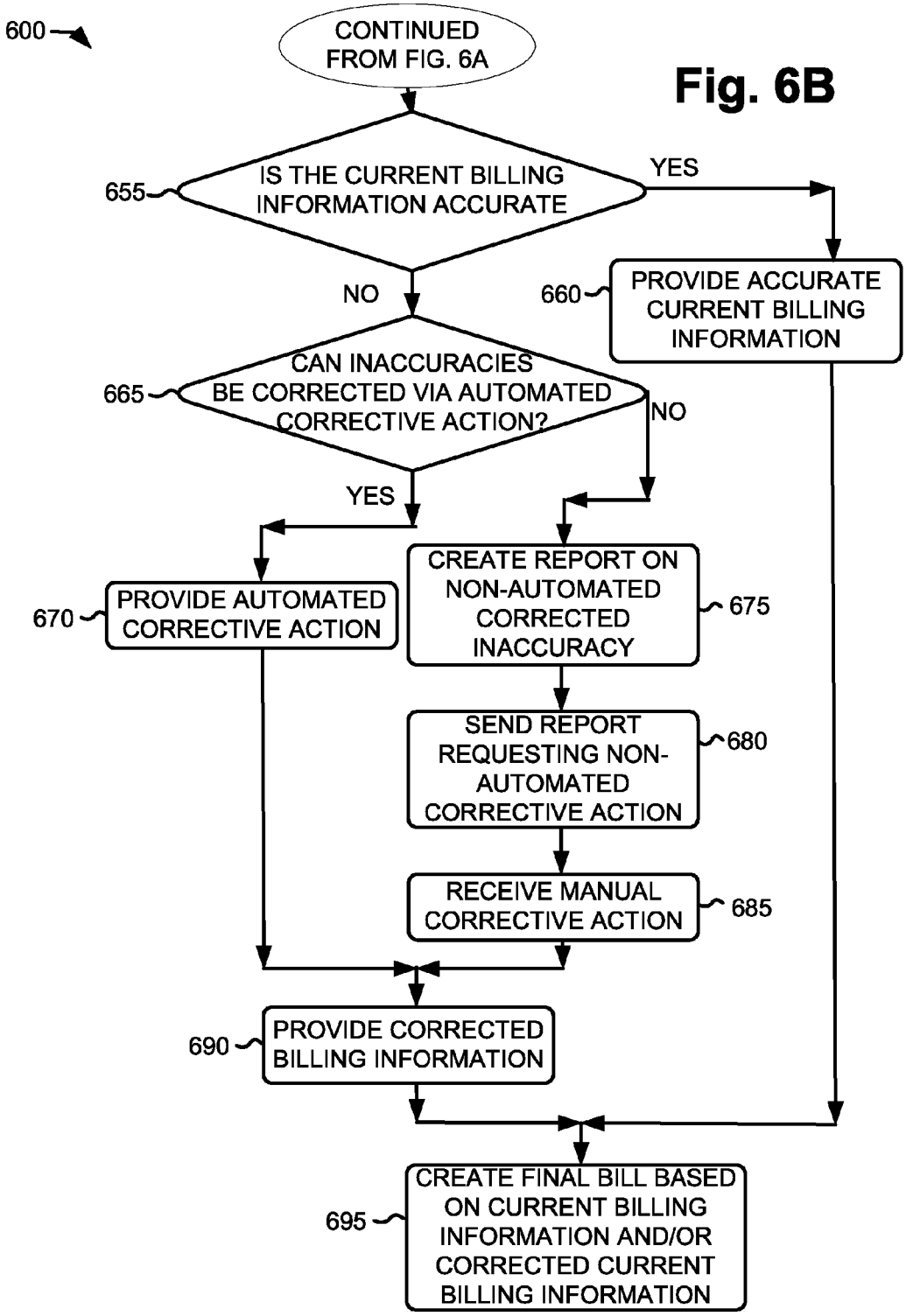
600
CONTINUED FROM FIG. 6A
Fig. 6B
655
IS THE CURRENT BILLING INFORMATION ACCURATE
YES
NO
660
PROVIDE ACCURATE CURRENT BILLING INFORMATION
665
CAN INACCURACIES BE CORRECTED VIA AUTOMATED CORRECTIVE ACTION?
NO
YES
670
PROVIDE AUTOMATED CORRECTIVE ACTION
CREATE REPORT ON NON-AUTOMATED CORRECTED INACCURACY
675
SEND REPORT REQUESTING NON-AUTOMATED CORRECTIVE ACTION
680
RECEIVE MANUAL CORRECTIVE ACTION
685
690
PROVIDE CORRECTED BILLING INFORMATION
695
CREATE FINAL BILL BASED ON CURRENT BILLING INFORMATION AND/OR CORRECTED CURRENT BILLING INFORMATION

MULTIPOINT BILLING QUALITY CONTROL AND CERTIFICATION

BACKGROUND

Billing for rendered services, such as telecommunications services, Internet services, etc., can be provided through automated billing processes and systems. Errors in automated billing processes and systems can occur when billing details are changed, such as when a promotional product or service is unintentionally dropped by a billing system, when one-time occurrence charges are entered incorrectly, etc. Such errors may generate bills that change by more than a particular amount or percentage, bills that are missing promotional information that should be applied, etc. These errors in automated billing processes and systems can lead to customer dissatisfaction, delays in payments, and customer service costs.

BRIEF DESCRIPTION OF THE DRAWINGS

FIGS. 6A and 6B are flow charts of an example process for providing multipoint billing quality control and certification according to an implementation described herein.

DETAILED DESCRIPTION

Figure 1:
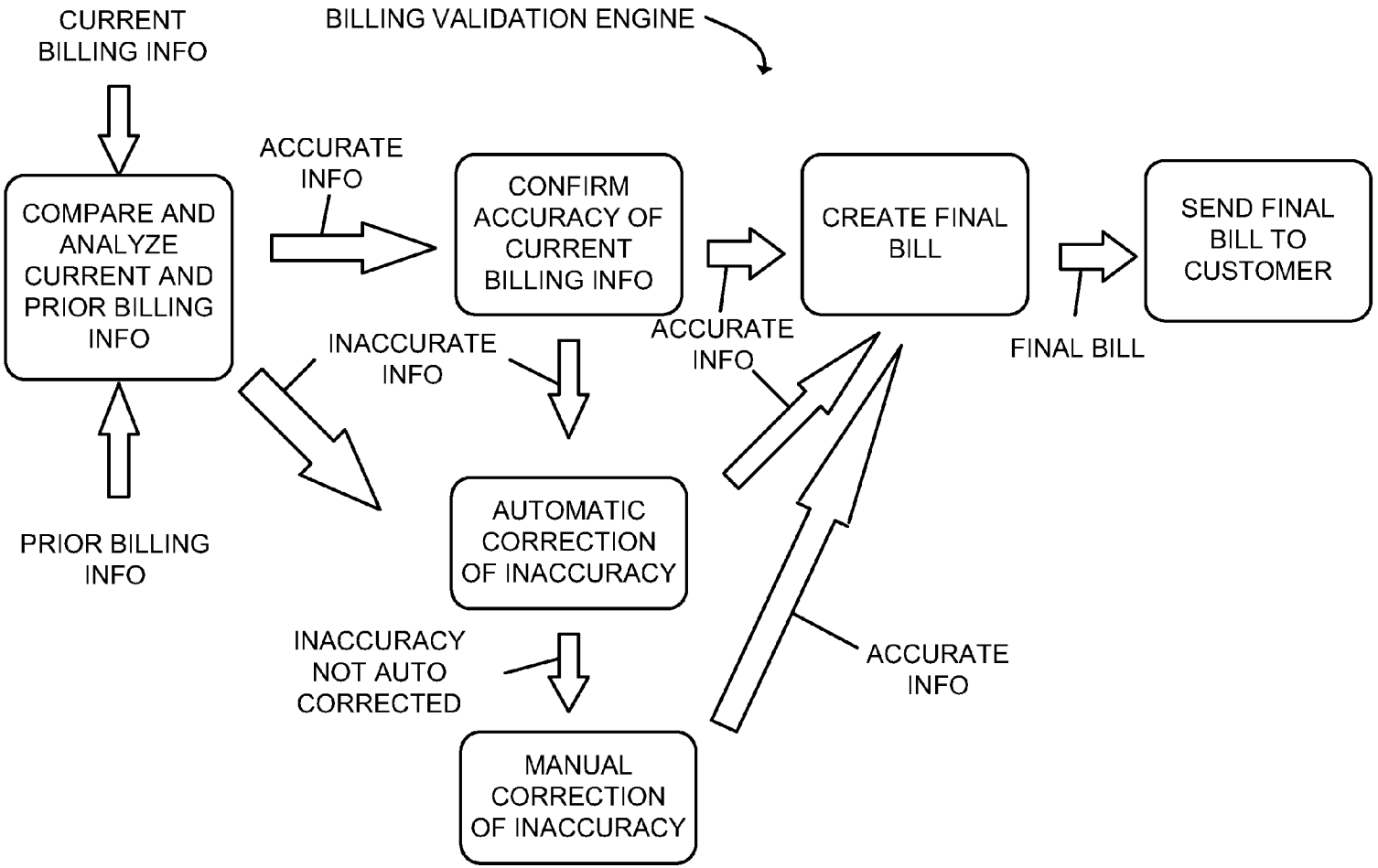
FIG. 1 is a diagram of an overview of an example implementation described herein.

The following detailed description refers to the accompanying drawings. The same reference numbers in different drawings may identify the same or similar elements.

Systems and/or methods, described herein, may provide quality control and accurate billing information for automatically generated bills. In one implementation, accurate billing information can be provided by automatically checking customer bills for inaccuracies before the customer bills are sent to a customer (e.g., via a print center or an electronic delivery system). Any customer bills that fail one or more automatic billing accuracy checks and are found to contain one or more inaccuracies can be flagged for further action. The further action may include automated correction and/or manual correction of the one or more inaccuracies, such that the customer receives an accurate bill.

In one implementation, accurate billing information can be provided by a billing validation engine. The billing information can include, for example, specific information about a particular bill, such as file identification information (e.g., identification names of computer files that are being validated or being used for validation), billing date information (e.g., a particular day in a billing cycle that a bill is issued), or particular bill line items (e.g. a particular entry on a bill, such as an entry on a detail line number, on an automatically generated customer bill). Billing information may also include, for example, information about a customer, such as a customer name, account identification information (e.g., an identification name of the account), account status information (e.g., active, inactive, suspended, etc.), class of service information (e.g., commercial, personal, administrative, etc.) that may be used to determine how the billing validation engine treats a particular bill, and company code information (e.g., if the account is assigned to a particular company). Billing information may include, for example, account information, such as a balance forward, total current charges, a total due, a billing type (e.g., electronic or paper type billing), direct payment options, and a payment due date. Billing information may also include, for example, mailing information for a paper bill, such as number of copies of the bill to print, a mailing address, and a remit address. Billing information may also include, for example, other information, such as bankruptcy information associated with a customer, late payment charges, disputed charges, etc.

In one example, the billing validation engine may include one or more server devices that check for inaccurate billing information (referred to herein as "billing inaccuracies"), correct billing inaccuracies, and provide accurate bills to a customer. Billing inaccuracies may include, for example, unintentional or incorrect changes to at least some of the billing information. For example, the billing validation engine may check for billing inaccuracies by comparing current billing information (e.g., billing information in a current billing cycle) to prior billing information (e.g., billing information from a prior billing cycle). Additionally, or alternatively, the billing validation engine may check for billing inaccuracies by comparing the current billing information with promotional information (e.g., discounts on a service or a product that a service provider offered and the customer accepted). Additionally, or alternatively, the billing validation engine may check for billing inaccuracies by comparing the current billing information to known customer service or technical support problems (e.g., complaints from other customers about particular items on bills that may occur on other bills). Additionally, or alternatively, the billing validation engine may check for billing inaccuracies by checking whether a particular set of rules (e.g., a list of items that needs to be included in all bills, not just to specific bills, such as legal notices, taxes, etc.) are properly applied to bills.

The billing validation engine may enable the billing inaccuracies to be automatically and/or manually corrected, and may provide an accurate final bill to a customer by creating the final bill based on the current billing information, if no billing inaccuracies are detected. Alternatively, or additionally, the billing validation engine may create the final bill based on corrected billing information, if billing inaccuracies are detected and corrected.

In one example, the billing validation engine may compare a current bill of a particular customer to a previous bill of the particular customer to determine if there have been any changes in the total amount billed (e.g., the total of all charges and credits) on the current bill, any changes in billing information provided in detailed line items of the current bill from the previous bill, or both. If there are changes in the current bill from the previous bill, the billing validation engine may analyze the current bill for one or more possible problems that may be causing such changes. For example, the billing validation engine may determine whether the particular customer has made intentional changes to their account, such as a change in subscription rate plan, adding or dropping services, account overages, etc., or if unintentional changes have been made, such as programming errors or incorrect entry of account numbers.

The billing validation engine may automatically check whether promotional information is missing from the current billing information. For example, if the customer has purchased a package deal with several products (e.g., modems, routers, mobile phones, etc.) and/or services (e.g., telephone usage plans, data usage plans, etc.) at a discounted rate (e.g., a specific dollar or percentage discount), the billing validation engine may confirm that the discounted rate is used rather than a non-discounted rate.

A "product," as the term is used herein, is to be broadly interpreted to include anything that may be marketed or sold as a commodity or a good. For example, a product may include modems, routers, mobile phones, etc. A "service," as the term is used herein, is to be broadly interpreted to include any act or variety of work done for others (e.g., for compensation). For example, a service may include a repair service (e.g., for a product), a warranty (e.g., for a product), telecommunication services (e.g., telephone services, Internet services, network services, radio services, television services, video services, etc.), etc.

The billing validation engine may also check whether known customer or technical support problems are affecting the current billing information. For example, if a particular customer fits a certain profile that is similar to other customers who are experiencing customer service or technical support problems, such as a computer coding error, then the particular customer's current billing information can be flagged for further attention.

The billing validation engine may check whether a set of rules is properly applied to the current billing information. The set of rules may include rules specifying a list of items to be included in all bills.

For example, the set of rules may include customer account information, such as one or more of the following: a file identifier, a billing date, a state code, an account identifier, a company code, a customer account number, an online service account number, a television service account number, a multi-line account, and a vendor-based television service account number. Alternatively, or additionally, the set of rules may include one or more of the following: a balance forward on an invoice, total new charges on an invoice, an amount due on an invoice, a billing method, a payment type, a due date on an invoice, a direct payment date, an account type, and a number of copies indicated for printing.

Alternatively, or additionally, the set of rules may include indicators of the presence or absence of an item on a bill, such as one or more of the following: a non-local exchange carrier indicator, a message priority indicator, a final bill indicator, a pull bill indicator, a billing telephone number, a scan line indicator on invoice, a mailing address indicator, a remit address indicator, a common messages indicator, a voice specific messages indicator, a television specific messages indicator, a digital television specific messages indicator, a credit reporting messages indicator, a bundle promotion indicator, a pay-per-view count indicators, and indicators of voice accounts, video accounts, data accounts, wireless accounts, vendor-based television service accounts, or high speed Internet accounts that may be included on a bill.

Alternatively, or additionally, the set of rules may include charges, such as one or more of the following: prorated vendor-based television service account amounts, late payment charge amounts, out of balance amounts (e.g., charges on a bill that are not added to a summary or total bill), current activity amounts, change in service charge amounts, tax amounts, provisional charge amounts, previous new charge amounts, long distance charge amounts, total payment amounts, adjustment amounts, and adjustment total amounts.

Alternatively, or additionally, the set of rules may include additional charges, such as one or more of the following: pay-per-view amounts, electronic transfer funds charge amounts, international charges account amounts, video unreturned equipment charge amounts, data unreturned equipment charge amounts, retained credit amounts, promotion amounts, carry over amounts, etc.

Alternatively, or additionally, the set of rules may include notice information, such as one or more of the following: legal notices, disconnection notices, miscellaneous charge notices, invalid charge descriptions, etc.

The billing validation engine may compare the current billing information to the set of rules to assure that each bill complies with the rules. In one implementation, a rules server may determine which rules should be applied to a specific customer based on the customer's current product set and may provide these rules to the billing validation engine. For example, mandatory legal messages, such as disconnection notices, payment notices, miscellaneous charge notices, or other required messages, may be required for certain products and/or services and may be provided as a set of rules to the billing validation engine.

The billing validation engine may store prior billing inaccuracies and may utilize the stored prior billing inaccuracies to correct current billing inaccuracies for bills with attributes similar to the bills stored by the billing validation engine. For example, if a prior set of bills include billing inaccuracies due to an internal programming error associated with a specific rate package (e.g., products and/or services that are grouped into packages available to customers), the billing validation engine may flag and analyze current bills with the same specific rate package and may look for the internal programming error in the flagged bills.

FIG. 1 is a diagram of an overview of an example implementation described herein. As illustrated in FIG. 1, a billing validation engine may be provided that can check for billing inaccuracies before a bill is sent to a customer. Initially, the billing validation engine may compare prior billing information and current billing information, and may confirm that promotional information and/or a set of rules are properly applied. The billing validation engine may analyze any differences between the current billing information and the prior billing information to determine whether one or more inaccuracies exist in the current billing information. If the current billing information includes accurate information, the billing validation engine may confirm the accuracy of the current billing information and may provide the accurate current billing information for creation of a final bill.

If one or more inaccuracies exist in the current billing information, the current billing information may be flagged for automatic correction or information associated with the one or more inaccuracies may be further processed. If the one or more inaccuracies are flagged for automatic correction, the billing validation engine may automatically correct the inaccuracies so that accurate corrected billing information can be provided to create the final bill. If the one or more inaccuracies cannot be automatically corrected, the billing validation engine may provide information associated with the one or more inaccuracies to an operator for manual correction, before the final bill is created. The accurate billing information may be utilized to create the final bill for the customer. The final bill may then be sent to the customer. Bills, as used herein, may include electronic bills, paper bills, or other types of bills.

Figure 2:
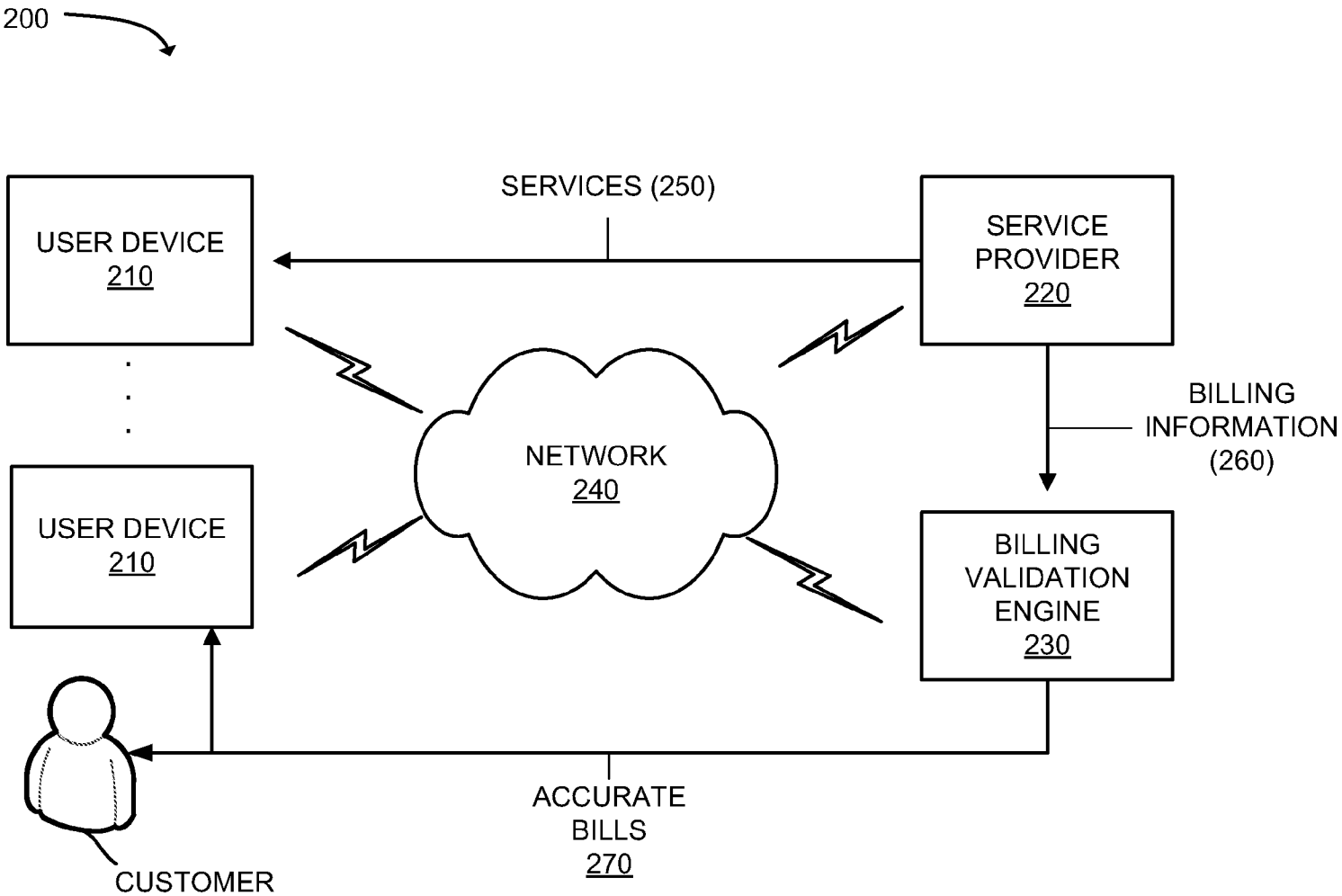
FIG. 2 is a diagram of an example environment in which systems and/or methods, described herein, may be implemented.

FIG. 2 is a diagram of an example environment 200 in which systems and/or methods described herein may be implemented. As illustrated in FIG. 2, example environment 200 may include a user device 210, a service provider 220, and a billing validation engine 230 interconnected by a network 240. Devices of environment 200 may interconnect via wired and/or wireless connections. Two user devices 210, one service provider 220, one billing validation engine 230, and one network 240 have been illustrated in FIG. 2 for simplicity. In practice, there may be more user devices 210, service providers 220, billing validation engines 230, and/or networks 240.

User device 210 may include a mobile device, such as a cellular telephone or a Personal Digital Assistant (PDA); a computing device, such as a tablet computer, a laptop computer, or a desktop computer; a gaming console; a set-top box (STB); a television; or any other device that may communicate via network 240 with service provider 220 and/or billing validation engine 230.

Service provider 220 may include a service provider who provides services 250, such as telecommunications services, Internet services, television services, satellite services, etc., to user device 210. Service provider 220 may also provide billing information 260 to billing validation engine 230. Alternatively, or additionally, service provider 220 may provide products to user device 210 or a customer associated with user device 210.

Billing validation engine 230 may include one or more server devices, or other types of computation and communication devices, that may check bills for billing inaccuracies, correct the billing inaccuracies, and provide accurate bills to a customer. In one implementation, as illustrated in FIG. 2, billing validation engine 230 may receive billing information 260 from service provider 220, may correct any inaccuracies in billing information 260, and may generate accurate bills 270 based on any corrected inaccuracies. Billing validation engine 230 may provide accurate bills 270 to user device 210 or to the customer associated with user device 210. Accurate bills 270 may include electronic bills provided to user device 210, paper bills that can be mailed to the customer's physical address, etc.

Network 240 can include any network that can provide communication between user device 210, service provider 220, and billing validation engine 230. In one implementation, network 240 can include a cellular network, a local area network (LAN), a wide area network (WAN) (e.g., the Internet), a metropolitan area network (MAN), an ad hoc network, a telephone network (e.g., a Public Switched Telephone Network (PSTN), or a voice-over-IP (VoIP) network), or a combination of networks.

Although FIG. 2 shows example devices/networks of environment 200, in other implementations, environment 200 may include fewer devices/networks, different devices/networks, differently arranged devices/networks, or additional devices/networks than depicted in FIG. 2. Alternatively, or additionally, one or more devices/networks of environment 200 may perform one or more tasks described as being performed by one or more other devices/networks of environment 200.

Figure 3:
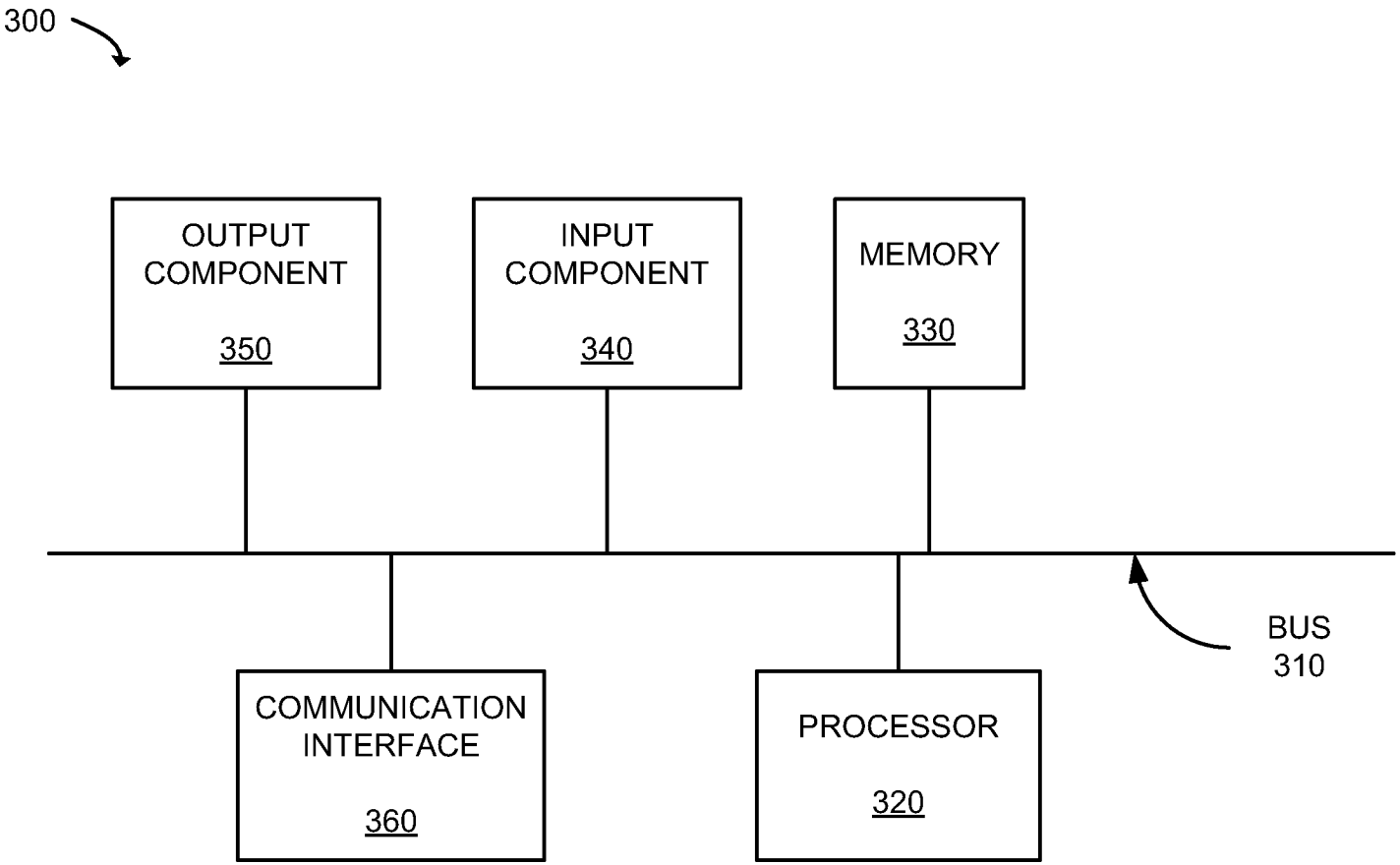
FIG. 3 is a diagram of example components of one or more devices of the environment depicted in FIG. 2.

FIG. 3 is a diagram of example components of a device 300 that may correspond to one or more devices of environment 200 (FIG. 2). In one example implementation, one or more of the devices of environment 200 may include one or more devices 300 or one or more components of device 300. As illustrated in FIG. 3, device 300 may include a bus 310, a processor 320, a memory 330, an input component 340, an output component 350, and a communication interface 360.

Bus 310 may include a path that permits communication among the components of device 300. Processor 320 may include a processor, microprocessor, or processing logic that may interpret and execute instructions. Memory 330 may include any type of dynamic storage device that may store information and instructions for execution by processor 320 and/or any type of non-volatile storage device that may store information for use by processor 320.

Input component 340 may include a mechanism that permits a user to input information to device 300, such as a keyboard, a keypad, a button, a switch, a microphone, a touch screen, etc. Output component 350 may include a mechanism that outputs information to the user, such as a display, a speaker, one or more light emitting diodes (LEDs), etc.

Communication interface 360 may include any transceiver-like mechanism that enables device 300 to communicate with other devices and/or systems via wireless communications (e.g., radio frequency, infrared, and/or visual optics, etc.), wired communications (e.g., conductive wire, twisted pair cable, coaxial cable, transmission line, fiber optic cable, and/or waveguide, etc.), or a combination of wireless and wired communications. For example, communication interface 360 may include mechanisms for communicating with another device or system via a network, such as network 240. Alternatively, or additionally, communication interface 360 may be a logical component that includes input and output ports, input and output systems, and/or other input and output components that facilitate the transmission of data to other devices.

As described herein, device 300 may perform certain operations in response to processing unit 320 executing software instructions contained in a computer-readable medium, such as memory 330. A computer-readable medium may be defined as a non-transitory memory device. A memory device may include space within a single physical memory device or spread across multiple physical memory devices. The software instructions may be read into memory 330 from another computer-readable medium or from another device. The software instructions contained in memory 330 may cause processor 320 to perform processes described herein. Alternatively, hardwired circuitry may be used in place of or in combination with software instructions to implement processes described herein. Thus, implementations described herein are not limited to any specific combination of hardware circuitry and software.

Although FIG. 3 shows example components of device 300, in other implementations, device 300 may contain fewer components, different components, differently arranged components, or additional components than depicted in FIG. 3. Alternatively, or additionally, one or more components of device 300 may perform one or more other tasks described as being performed by one or more other components of device 300.

Figure 4:
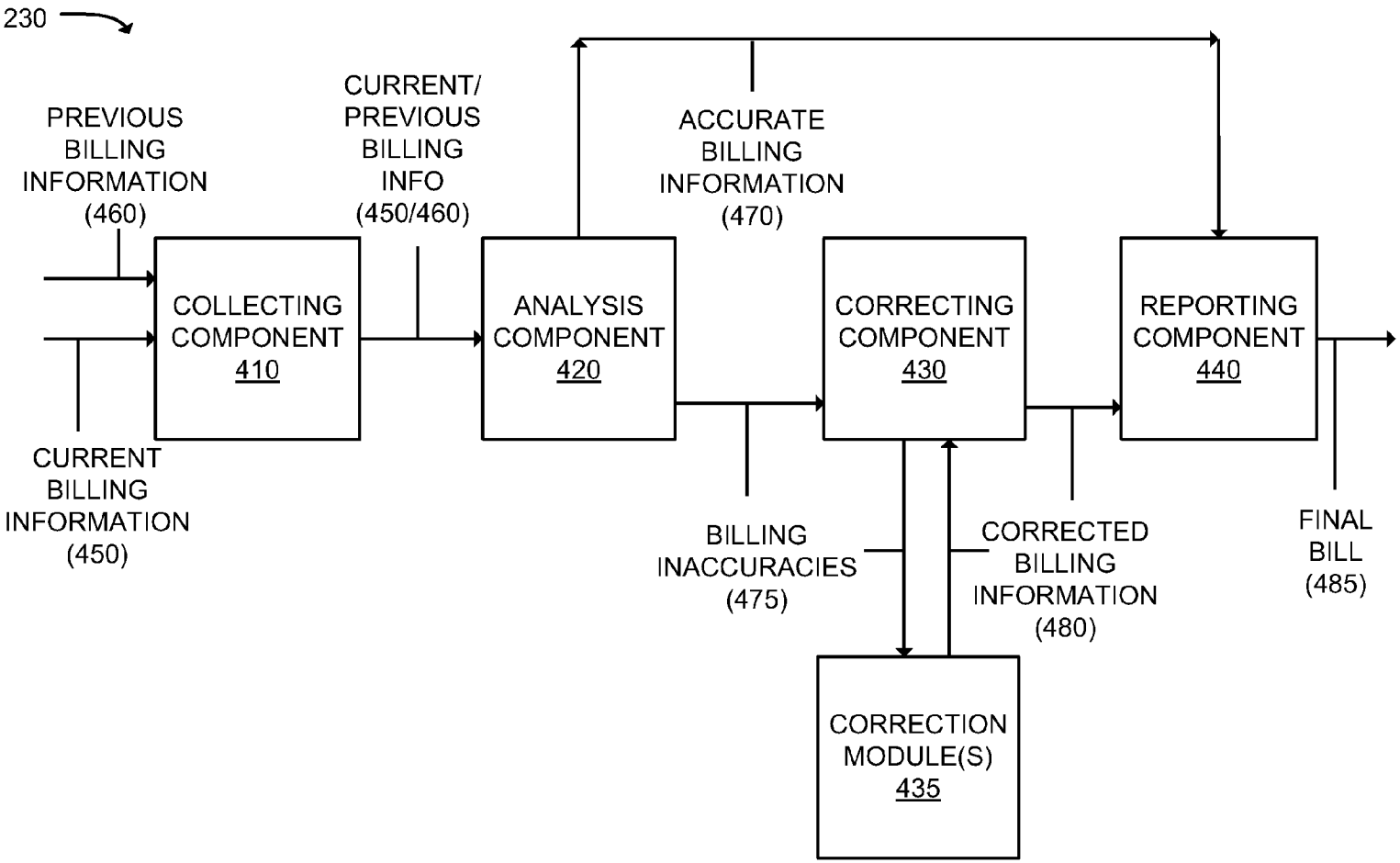
FIG. 4 is a diagram of example functional components of a billing validation engine depicted in FIG. 2.

FIG. 4 is a diagram of example functional components of billing validation engine 230 (FIG. 230). In one implementation, the functions described in connection with FIG. 4 may be performed by one or more components of device 300 (FIG. 3) or by one or more devices 300. As shown in FIG. 4, billing validation engine 230 may include a collecting component 410, an analysis component 420, a correcting component 430, correction module(s) 435, and a reporting component 440.

Collecting component 410 may collect information from one or more systems. In one implementation, collecting component 410 may receive current billing information 450, which may include current usage charges provided by a bill generating system, current contact information provided by a bill records system, discounts or credits provided by a promotions system, etc. Additionally, or alternatively, collecting component 410 may receive prior billing information 460, which may include previous usage charges and previous contact information provided by the bill records system, previously applied discounts or credits provided by the promotions system, etc. As further shown in FIG. 4, collecting component 410 may provide current billing information 450 and prior billing information 460 to analysis component 420.

Analysis component 420 may receive current billing information 450 and prior billing information 460, and may compare and analyze current billing information 450 and prior billing information 460. In one implementation, analysis component 420 may compare current billing information 450 with prior billing information 460 in order to locate inaccuracies in current billing information 450. For example, analysis component 420 may compare a current monthly bill to a previous monthly bill in order to determine whether there have been any changes in the current monthly bill. If there are changes in the current monthly bill, analysis component 420 may determine whether the changes are causing one or more billing inaccuracies (e.g., changes in the charges, the address of the account holder, etc. in the current monthly bill from the previous monthly bill).

Additionally, or alternatively, analysis component 420 can compare the currently applied promotional information (e.g., discounts, credits, or rate codes that may be applied to the current billing information) to any previously applied promotional information (e.g., discounts, credits, or rate codes applied to prior billing information) to determine whether the currently applied promotional information has been properly applied to the current billing information 450. For example, the currently applied promotional information may be incorrectly applied (e.g., a preset discount percentage may be incorrect, a set dollar amount may be incorrect when compared to a previously applied promotion, etc.) or unintentionally omitted from the billing information. Such actions may create inaccuracies that may need correction (e.g., reinstatement of previously applied promotions, correction to a predetermined amount to a promotion, etc.).

If analysis component 420 determines that current billing information 450 includes accurate billing information 470, analysis component 420 may provide accurate billing information 470 to reporting component 440. However, if analysis component 420 determines that current billing information 450 includes billing inaccuracies 475, analysis component 420 may provide inaccuracies 475 to correction component 430.

Analysis component 420 may determine whether billing inaccuracies 475 can be corrected automatically or require manual correction. In one implementation, analysis component 420 may determine that billing inaccuracies 475 can be automatically corrected by correcting component 430, and analysis component 420 may send billing inaccuracies 475 to correcting component 430 for automatic correction. For example, analysis component 420 may determine that an incorrect rate plan has been applied to current billing information 450, and correcting component 430 may correct the incorrect rate plan and change current billing information 450 to the correct rate plan. After correcting one or more billing inaccuracies 475, correcting component 430 may provide corrected billing information 480 to reporting component 440.

Analysis component 420 may analyze an inaccuracy 475 and determine that the billing information is accurate 470. In one implementation, analysis component 420 can provide the accurate billing information 470 directly to reporting component 440.

Analysis component 420 may analyze a particular billing inaccuracy 475 and may determine that the particular billing inaccuracy 475 requires further attention and/or manual correction. Analysis component 420 may report billing inaccuracies 475 to customer support personnel, technical support personnel, or others. The reported billing inaccuracies 475 may be provided via an interface to such personnel.

In one example, analysis component 420 can provide the reports via a web interface that may allow various specialists, systems, or both to view the reports. For example, analysis component 420 may report a particular billing inaccuracy 475 to a billing specialist or an information technology support specialist via the web interface.

Additionally, or alternatively, analysis component 420 may identify (e.g., as billing inaccuracies 475) a service order problem (e.g., a change in rate plan, overages charges, etc.), and may report the service order problem to an ordering system specialist. Additionally, or alternatively, analysis component 420 may identify a payment related problem, and may report the problem to a payment system specialist. Additionally, or alternatively, analysis component 420 may identify a bill calculation related inaccuracy, and may report the inaccuracy to a bill calculating system specialist. Additionally, or alternatively, analysis component 420 may identify a bill format related problem, and may report the problem to a bill format system specialist.

Analysis component 420 may determine that current billing information 450 is sufficiently accurate when analysis component 420 can confirm a particular accuracy for current billing information 450, even if billing inaccuracies 475 are found. In one implementation, if current billing information 450 is accurate to within a certain percentage (e.g., 1%, 5%, 10%, etc.) of prior billing information 460, analysis component 420 may confirm the accuracy of current billing information 450. For example, analysis component 420 may include a margin of error that may allow for changes to current billing information 450 that would not be flagged for correction.

Analysis component 420 may identify billing inaccuracies 475 based upon customer complaints. In one implementation, customer complaints may be monitored and if analysis component 420 determines that billing inaccuracies 475, associated with the customer complaints, in current billing information 450, may be automatically corrected, analysis component 420 may flag billing inaccuracies 475 for automatic correction. Additionally, or alternatively, if analysis component 420 determines that billing inaccuracies 475 should be reported for manual correction (e.g., when billing inaccuracies 475 cannot be corrected automatically), analysis component 420 may report billing inaccuracies 475, associated with the customer complaints, for manual correction.

Correcting component 430 may correct billing inaccuracies 475 identified by analysis component 420. In one implementation, correcting component 430 may automatically correct billing inaccuracies 475 in current billing information 450, such as incorrectly applied charges, to create corrected billing information 480. Corrected billing information 480 may include billing information that has been automatically or manually corrected such that a final bill based on the corrected billing information 480 may be sufficiently accurate (e.g., correct mailing address, correct mandatory notices, billing amounts within a predetermined margin from a prior billing amount, etc.). For example, correcting component 430 may automatically correct incorrectly applied charges, such as incorrect charges to bundle indicators, promotions, credits, adjustments, late payment charges, unreturned equipment charges, unreturned modem charges, taxes, value added services (e.g., additional storage, PC security products, etc.), third party charges, etc.

Correcting component 430 may be used by various specialists, systems, or both to provide corrected billing information 480 to reporting component 440. In one implementation, specialists or systems may manually correct billing inaccuracies 475 in current billing information 450, and may enter these manual corrections via correcting component 430 to correct billing inaccuracies 475 and to create corrected billing information 480. For example, if correcting component 430 reports a bill calculation-related inaccuracy to a billing specialist, the billing specialist may analyze the inaccuracy, and may interact with correcting component 430 to manually correct the bill calculation-related inaccuracy and to create corrected billing information 480. As further shown in FIG. 4, correcting component 430 may provide corrected billing information 480 to reporting component 440.

Correcting component 430 may automatically correct billing in accuracies 475 or may provide billing in accuracies 475 to one or more correction modules 435 for automatic correction. Alternatively, or additionally, correction modules 435 may be incorporated within correcting component 430. For example, correction modules 435 may include formatting-type correction modules (e.g., that can format a paper or an electronic bill such that each entry of data is properly aligned with a correct header label), retail integrated-type correction modules (e.g., that can update billing information when a retail order is placed), address-type correction modules (e.g., that can correct an address of a customer based upon either a customer's new entry or a previously stored entry), etc.

In one implementation, a type of correction module 435 may be selected, by correcting component 430, based upon the billing inaccuracies 475 that are known to be automatically correctable by one of correction modules 435. For example, if billing inaccuracies 475 involve formatting inaccuracies (e.g., lines in current billing information 450 are not aligned in the proper formatting), correcting component 430 may automatically send the formatting inaccuracies to a formatting-type correction module 435 for correction.

Reporting component 440 may receive accurate billing information 470 and/or corrected billing information 480, and may generate a final bill 485 based on accurate billing information 470 and/or corrected billing information 480. Final bill 485 may include billing information that has undergone analysis and passed without problems (e.g., accurate billing information 470), or has undergone analysis and passed after billing inaccuracies 475 were corrected (e.g., corrected billing information 480).

Although FIG. 4 shows example functional components of billing validation engine 230, in other implementations, billing validation engine 230 may contain fewer functional components, different functional components, differently arranged functional components, or additional functional components than depicted in FIG. 4. Alternatively, or additionally, one or more functional components of billing validation engine 230 may perform one or more other tasks described as being performed by one or more other functional components of billing validation engine 230.

Figure 5:
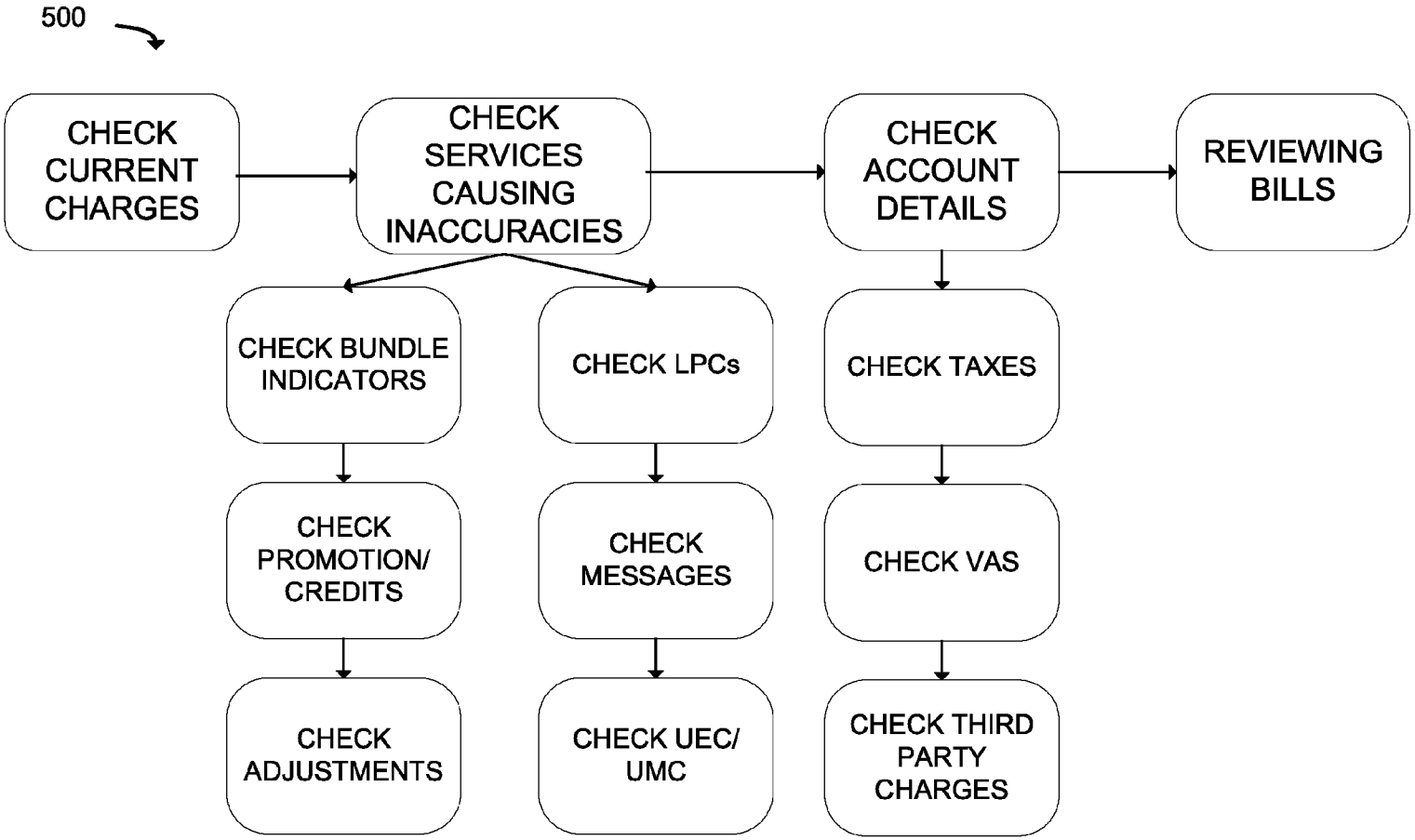
FIG. 5 is a diagram of services and account details that can be accessed for analysis and/or correction by the billing validation engine.

FIG. 5 is a diagram of services and account details 500 that can be accessed for analysis and/or correction by billing validation engine 230. As shown in FIG. 5, billing validation engine 230 may check current charges for services that may be causing an increase in current billing information 450, may check for services causing inaccuracies, may check account details, and may review bills. In one implementation, services and account details 500 may be included in current billing information 450 and/or prior billing information 460.

Billing validation engine 230 may check current charges for services by comparing current billing information 450 with prior billing information 460. When checking current charges for services causing inaccuracies, billing validation engine 230 may check for one time or recurring charges. For example, billing validation engine 230 may check: bundle indicators (e.g., codes or identifiers that indicate when multiple services are bundled together for a discounted rate), promotions/credits (e.g., discounts, credits, or rate codes that may apply to current billing information 450), billing adjustments (e.g., manual or automatic credits or debits based on inaccuracies), Late Payment Charges (LPCs) (e.g., one time charges for late payment), messages to customers (e.g., legal notices, etc.), Unreturned Equipment Charges (UECs) (e.g., one time charges for equipment that belonged to a service provider and was not returned, resulting in the one-time charge for the equipment) or Unreturned Modem Charges (UMCs) (e.g., one-time charges for modems that belonged to a service provider and was not returned), or any other services that may be causing billing inaccuracies 475.

When checking account details, billing validation engine 230 may check for account specific details that may cause billing inaccuracies 475 in current billing information 450. For example, billing validation engine 230 may check: taxes (e.g., local and/or state taxes, and/or federal surcharges), Value Added Services (VAS) (e.g., additional storage, computing security products, etc.), third party charges (e.g., long distance providers, international roaming charges, etc.), or other account details that may cause billing inaccuracies 475.

When reviewing bills, billing validation engine 230 may compare current billing information 450 to prior billing information 460 to identify changes that may be inaccurate. Billing validation engine 230 may compare current billing information 450 to promotional information to determine if the promotional information was improperly applied and thus may be inaccurate. Billing validation engine 230 may compare current billing information 450 to a set of rules to determine if the set of rules have been applied and are included in current billing information 450.

Current billing information 450 and prior billing information 460 may include one or more of the following: a file identification, a billing date, an account status, an account identification, a bill line sequence number, a company code, a balance forward, total current charges, total due, a billing type, a direct payment option, a date due, a class of service, a number of copies, a mailing address, a remit address, bankruptcy information, late payment charges, disputed charges, a customer name, etc. Current billing information 450 may include current versions of this information and prior billing information may include prior versions of this information.

Although FIG. 5 shows example services and account details 500 that can be accessed for analysis and/or correction by billing validation engine 230, in other implementations, billing validation engine 230 may access fewer services and account details, different services and account details, or additional services and account details than depicted in FIG. 5.

FIGS. 6A and 6B are flow charts of an example process 600 for providing multipoint billing quality control and certification according to an implementation described herein. In one implementation, process 600 may be performed by billing validation engine 230. Alternatively, or additionally, one or more blocks of process 600 may be performed by another device or group of devices, including or excluding billing validation engine 230.

As illustrated in FIG. 6A, process 600 may include receiving current billing information and prior billing information associated with an account (block 610). For example, in an implementation described above in connection with FIG. 4, collecting component 410 of billing validation engine 230 may receive current billing information 450 and prior billing information 460. For example, collecting component 410 may receive current billing information 450 from a bill generating system and may receive prior billing information 460 from a bill records system.

As further shown in FIG. 6A, process 600 may include comparing the current billing information and the prior billing information to determine accuracies or inaccuracies in the current billing information (block 620). For example, in an implementation described above in connection with FIG. 4, analyzing component 420 of billing validation engine 230 may compare current billing information 450 and prior billing information 460 to determine whether there are any inaccuracies in current billing information 450. For example, analyzing component 420 can analyze current billing information 450 and prior billing information 460 determine whether current billing information 450 is sufficiently accurate (e.g., within a predetermined margin for each value), or whether current billing information 450 has inaccuracies as compared to prior billing information 460. The inaccuracies may include, for example, inconsistencies between current billing information 450 and prior billing information 460 in rate plans, services, bill formatting, account information, inclusion of a payment envelope, etc.

In one example, analyzing component 420 may compare current billing information 450 and prior billing information 460 based on one or more of the following types of information: file identification, billing date, account status, account identification, bill line sequence number, company code, balance forward, total current charges, total due, billing type, direct payment option, date due, class of service, number of copies, mailing address, remit address, bankruptcy information, late payment charges, disputed charges, customer name, etc.

Returning to FIG. 6A, process 600 may include confirming that promotional information is properly applied to the current billing information (block 630). For example, in an implementation described above in connection with FIG. 4, analysis component 420 of billing validation engine 230 may compare promotional information, such as discounts, credits, or rate codes with current billing information 450 and/or with discrepancies in current billing information 450 and prior billing information 460 to determine whether the discrepancies are due to the promotional information. In one example, the promotional information may include limited time offers, group discounts, packages (e.g., two or more services packaged at a discounted rate), etc.

Returning to FIG. 6A, process 600 may include comparing information about known customer or technical problems with the current billing information to determine accuracies or inaccuracies in the current billing information (block 635). For example, in an implementation described above in connection with FIG. 4, analysis component 420 of billing validation engine 230 may compare known customer or technical problems to determine whether there are inaccuracies. For example, analysis component 420 may compare known customer or technical problems with current billing information 450 and/or with inaccuracies in current billing information 450 and prior billing information 460 to determine whether the inaccuracies are due to the known customer or technical problems. In one example, the known customer or technical problems may include customer service reported problems (e.g., common billing inaccuracies of any threshold amount, unusual billing inaccuracies with high value errors, etc.) or known server, software, or other technical inaccuracies (e.g., incorrectly formatted bills, mislabeled services, etc.).

As further shown in FIG. 6A, process 600 may include confirming that a set of rules are properly applied to the current billing information to determine accuracies or inaccuracies in the current billing information (block 640). For example, in an implementation described above in connection with FIG. 4, analysis component 420 can determine if a set of rules are correctly applied to current billing information 450 in order to determine whether there are accuracies or inaccuracies in current billing information 450. For example, analysis component 420 can determine which set of rules should be applied based on current billing information 450 and can confirm that the correct set of rules are applied. For example, if a mandatory Public Utilities Commission (PUC) statement is required based upon a provided telecommunication service, analysis component 420 may confirm that the correct PUC statement is present in current billing information 450.

In one example, analysis component 420 may determine inaccuracies in current billing information 450 when at least one of the rules in the set of rules is not properly applied in current billing information 450. For example, if analysis component 420 determines that a mandatory legal message is missing from or is incorrect in current billing information 450, analysis component 420 may flag the missing legal message as an inaccuracy.

Process 600 may include gathering details of inaccuracies from the current billing information (block 650). For example, analysis component 420 may gather details of the inaccuracies determined in blocks 620, 630, and/or 640. In one example, analysis component 420 may gather details of inaccuracies, such as increased rates, missing bundle indicators, missing promotions, decreased credits, etc.

As illustrated in FIG. 6B, process 600 may include determining whether the current billing information is accurate (block 655). For example, in an implementation described above in connection with FIG. 4, analysis component 420 may determine whether current billing information 450 is accurate within a predetermined amount. In one example, analysis component 420 may compare a total charge in current billing information 450 with a total charge in prior billing information 460 and may determine that the total charge in current billing information 450 is within a predetermined margin (e.g., 1%, 5%, 10%, etc.) of the total charge of prior billing information 460.

As further shown in FIG. 6B, if the current billing information is accurate (block 655—YES), process 600 may include providing the accurate current billing information to create a final bill (block 660). For example, in an implementation described above in connection with FIG. 4, accurate billing information 470 may be provided from analysis component 420 to reporting component 440.

If the current billing information is not accurate (block 655—NO), process 600 may include determining whether any inaccuracies can be corrected via automated corrective action (block 665). For example, in an implementation described above in connection with FIG. 4, correcting component 430 can determine whether any billing inaccuracies 475 can be automatically corrected. In one example, correcting component 430 may compare details of billing inaccuracies 475 with a list of inaccuracies that correcting component 430 can correct automatically to determine if any of billing inaccuracies 475 are on the list.

In one example, correcting component 430 may store (e.g., in a data structure) the potential inaccuracies that correcting component 430 can automatically correct. For example, correcting component 430 may identify incorrectly applied charges to bundle indicators, promotions, credits, adjustments, late payment charges, unreturned equipment charges, unreturned modem charges, taxes, value added services (e.g., additional storage, PC security products, etc.), or third party charges, as inaccuracies that correcting component 430 can automatically correct.

Alternatively, or additionally, correcting component 430 may store (e.g., in a data structure) potential inaccuracies that correcting component 430 cannot automatically correct, such as, for example, potential billing inaccuracies that may only be manually corrected. Correcting component 430 may create flags for inaccuracies that are not stored in the data structures. For example, correcting component 430 may create flags for inaccuracies that have not been previously identified.

If the inaccuracies can be automatically corrected (block 665—YES), process 600 may include providing automated corrective action (block 670). For example, in an implementation described above in connection with FIG. 4, correcting component 430 may provide automated corrective action on billing inaccuracies 475 that can be automatically corrected. In one example, correcting component 430 may automatically correct billing inaccuracies 475, such as incorrectly applied charges, incorrectly applied promotions, and/or incorrectly applied rules. Additionally, or alternatively, correcting component 430 may automatically correct billing inaccuracies 475 by providing billing inaccuracies 475 to one of correction modules 435, and correction module 435 may correct billing inaccuracies 475 and may provide corrected billing information 480 to correcting component 430.

If the inaccuracies cannot be automatically corrected (block 665—NO), process 600 may include creating a report of the non-automatically corrected inaccuracies (block 675). In one implementation, correcting component 430 may create a report about at least one of the inaccuracies that was not corrected via automated corrective action. The report may include the details of the inaccuracies, and may be provided to an operator for manual correction.

Process 600 may include sending the report requesting non-automated corrective action for the non-automatically corrected inaccuracies (block 680). In one implementation, correcting component 430 may send the report requesting non-automated corrective action (e.g., manual corrective action) to an appropriate specialist or system. For example, correcting component 430 may send a report to a billing specialist if the potential problem includes billing inaccuracies that cannot be automatically corrected by correcting component 430.

Process 600 may include receiving manual corrective action (block 685). In one implementation, correcting component 430 may receive manual corrective action from an appropriate specialist or system. For example, correcting component 430 may receive manual corrective action from a billing specialist if billing inaccuracies 475 cannot be automatically corrected by correcting component 430, and the billing specialist can provide corrected billing information 480 to correcting component 430.

As further shown in FIG. 6, process 600 may include providing corrected billing information for generating a final bill (block 690). For example, in an implementation described above in connection with FIG. 4, correcting component 430 may provide corrected billing information 480 to reporting component 440.

Returning to FIG. 6, process 600 may include creating a final bill based on accurate current billing information and/or on corrected current billing information (block 695). In one implementation, reporting component 440 may receive accurate billing information 470, corrected billing information 480 with corrected billing inaccuracies 475 (e.g., automatically corrected or manually corrected), or both, such that final bill 485 may be prepared and certified as correct.

Systems and/or methods, described herein, may provide quality control and accurate billing information for automatically generated bills. In one implementation, accurate billing information can be provided by automatically checking customer bills for inaccuracies before the customer bills are sent to a customer.

The foregoing description provides illustration and description, but is not intended to be exhaustive or to limit the implementations to the precise form disclosed. Modifications and variations are possible in light of the above disclosure or may be acquired from practice of the implementations.

While a series of blocks has been described with regard to FIGS. 6A and 6B, the order of the blocks may be modified in other implementations. Further, non-dependent blocks may be performed in parallel.

It will be apparent that systems and/or methods, as described above, may be implemented in many different forms of software, firmware, and hardware in the implementations illustrated in the figures. The actual software code or specialized control hardware used to implement these systems and methods is not limiting of the embodiments. Thus, the operation and behavior of the systems and methods were described without reference to the specific software code—it being understood that software and control hardware can be designed to implement the systems and/or methods based on the description herein.

Further, certain portions, described above, may be implemented as a component that performs one or more functions. A component, as used herein, may include hardware, such as a processor, an Application Specific Integrated Circuit (ASIC) or a Field Programmable Gate Array (FPGA), or a combination of hardware and software (e.g., a processor and executing software).

Even though particular combinations of features are recited in the claims and/or disclosed in the specification, these combinations are not intended to limit the disclosure of the embodiments. In fact, many of these features may be combined in ways not specifically recited in the claims and/or disclosed in the specification. Although each dependent claim listed below may directly depend on only one other claim, the disclosure of the embodiments includes each dependent claim in combination with every other claim in the claim set.

No element, act, or instruction used in the present application should be construed as critical or essential to the embodiments unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A method comprising:

storing, in a memory, a data structure comprising a first plurality of prior billing inaccuracies identified as being automatically correctable by one or more devices and a second plurality of prior billing inaccuracies identified as being manually correctable;

receiving, by the one or more devices, current billing information associated with a particular account;

receiving, by the one or more devices, prior billing information associated with the particular account;

comparing, by the one or more devices, the current billing information and the prior billing information to determine whether a first type of inaccuracy exists in the current billing information;

determining, by the one or more devices, whether promotional information is applied to the current billing information to determine whether a second type of inaccuracy exists in the current billing information;

determining, by the one or more devices, whether a set of billing rules is applied to the current billing information to determine whether a third type of inaccuracy exists in the current billing information;

determining, by the one or more devices and when one or more inaccuracies, each comprising the first, second or third type of inaccuracy, exist in the current billing information, whether the one or more inaccuracies are automatically correctable or manually correctable, wherein determining whether the one or more inaccuracies are automatically correctable or manually correctable comprises:

comparing each of the one or more inaccuracies with the first and second plurality of prior billing inaccuracies stored in the data structure of the memory, and identifying, based on the comparing, first ones of the one or more inaccuracies that are automatically correctable and second ones of the one or more inaccuracies that are manually correctable;

correcting, automatically by the one or more devices, the first ones of the one or more inaccuracies identified as automatically correctable;

generating, by the one or more devices, a request for manual correction of the second ones of the one or more inaccuracies identified as manually correctable;

receiving, by the one or more devices and based on the request, manual correction of the second ones of the one or more inaccuracies; and creating, by the one or more devices, a final bill for the particular account based on the current billing information, the automatically corrected first ones of the one or more inaccuracies, and the manually corrected second ones of the one or more inaccuracies.

2. The method of claim 1, wherein the current billing information comprises:

information associated with one or more of a file identification, a billing date, an account status, an account identification, a bill line sequence number, a company code, a balance forward, total current charges, a total due, a billing type, a direct payment option, a due date, a class of service, a number of copies, a mailing address, a remit address, bankruptcy information, late payment charges, and disputed charges.

3. The method of claim 1, wherein the first type of inaccuracy exists when there are one or more differences between the current billing information and the prior billing information.

4. The method of claim 1, wherein the second type of inaccuracy exists when there are one or more differences between promotional information in the current billing information and promotional information in the prior billing information.

5. The method of claim 1, wherein the request includes a report identifying the second ones of the one or more inaccuracies identified as manually correctable.

6. The method of claim 1, wherein the promotional information includes discounts, credits, or rate codes that apply to the current billing information.

7. The method of claim 1, further comprising:

receiving information about a customer or technical problem; and comparing the information about the customer or technical problem to the current billing information to determine whether a fourth type of inaccuracy exists in the current billing information.

8. The method of claim 1, wherein the set of rules include legal notices, taxes, payment notices, and charge notices.

9. A system comprising:

a memory configured to store a data structure comprising a first plurality of prior billing inaccuracies identified as being automatically correctable and a second plurality of prior billing inaccuracies identified as being manually correctable; and one or more devices configured to:

receive current billing information associated with a particular account;

receive prior billing information associated with the particular account;

compare the current billing information and the prior billing information to determine whether a first type of inaccuracy exists in the current billing information;

determine whether promotional information is applied to the current billing information to determine whether a second type of inaccuracy exists in the current billing information;

determine whether a set of billing rules is applied to the current billing information to determine whether a third type of inaccuracy exists in the current billing information;

determine, when one or more inaccuracies, each comprising the first, second or third type of inaccuracy, exist in the current billing information, whether the one or more inaccuracies are automatically correctable or manually correctable, wherein, when determining whether the one or more inaccuracies are automatically correctable or manually correctable, the one or more devices are further configured to:

compare each of the one or more inaccuracies with the first and second plurality of prior billing inaccuracies stored in the data structure of the memory, and identify, based on the comparing, first ones of the one or more inaccuracies that are automatically correctable and second ones of the one or more inaccuracies that are manually correctable;

automatically correct the first ones of the one or more inaccuracies identified as automatically correctable;

generate a request for manual correction of the second ones of the one or more inaccuracies identified as manually correctable;

receive, based on the request, manual correction of the second ones of the one or more inaccuracies; and create a final bill for the particular account based on the current billing information, the automatically corrected first ones of the one or more inaccuracies, and the manually corrected second ones of the one or more inaccuracies.

10. The system of claim 9, wherein the current billing information comprises:

information associated with one or more of a file identification, a billing date, an account status, an account identification, a bill line sequence number, a company code, a balance forward, total current charges, a total due, a billing type, a direct payment option, a due date, a class of service, a number of copies, a mailing address, a remit address, bankruptcy information, late payment charges, and disputed charges.

11. The system of claim 9, wherein the first type of inaccuracy exists when there are one or more differences between the current billing information and the prior billing information.

12. The system of claim 9, wherein the second type of inaccuracy exists when there are one or more differences between promotional information in the current billing information and promotional information in the prior billing information.

13. The system of claim 9, wherein the request includes a report identifying the second ones of the one or more inaccuracies identified as manually correctable.

14. The system of claim 9, wherein the promotional information includes discounts, credits, or rate codes that apply to the current billing information.

15. The system of claim 9, wherein the one or more devices are further configured to:

receive information about a customer or technical problem; and compare the information about the customer or technical problem to the current billing information to determine whether a fourth type of inaccuracy exists in the current billing information.

16. The system of claim 9, wherein the set of rules include legal notices, taxes, payment notices, and charge notices.

17. A non-transitory computer-readable medium containing instructions executable by at least one processor, the non-transitory computer-readable medium comprising:

one or more instructions for storing a data structure comprising a first plurality of prior billing inaccuracies identified as being automatically correctable and a second plurality of prior billing inaccuracies identified as being manually correctable;

one or more instructions for receiving current billing information associated with a particular account;

one or more instructions for receiving prior billing information associated with the particular account;

one or more instructions for comparing the current billing information and the prior billing information to determine whether a first type of inaccuracy exists in the current billing information;

one or more instructions for determining whether promotional information is applied to the current billing information to determine whether a second type of inaccuracy exists in the current billing information;

one or more instructions for determining whether a set of billing rules is applied to the current billing information to determine whether a third type of inaccuracy exists in the current billing information;

one or more instructions for determining, when one or more inaccuracies, each comprising the first, second or third type of inaccuracy, exist in the current billing information, whether the one or more inaccuracies are automatically correctable or manually correctable, wherein the one or more instructions for determining whether the one or more inaccuracies are automatically correctable or manually correctable comprise:

one or more instructions for comparing each of the one or more inaccuracies with the first and second plurality of prior billing inaccuracies stored in the data structure of the memory, and one or more instructions for identifying, based on the comparing, first ones of the one or more inaccuracies that are automatically correctable and second ones of the one or more inaccuracies that are manually correctable;

one or more instructions for automatically correcting the first ones of the one or more inaccuracies identified as automatically correctable;

one or more instructions for generating a request for manual correction of the second ones of the one or more inaccuracies identified as manually correctable;

one or more instructions for receiving, based on the request, manual correction of the second ones of the one or more inaccuracies; and one or more instructions for creating a final bill for the particular account based on the current billing information, the automatically corrected first ones of the one or more inaccuracies, and the manually corrected second ones of the one or more inaccuracies.

18. The non-transitory computer-readable medium of claim 17, wherein the current billing information comprises:

information associated with one or more of a file identification, a billing date, an account status, an account identification, a bill line sequence number, a company code, a balance forward, total current charges, a total due, a billing type, a direct payment option, a due date, a class of service, a number of copies, a mailing address, a remit address, bankruptcy information, late payment charges, and disputed charges.

19. The non-transitory computer-readable medium of claim 17, wherein the first type of inaccuracy exists when there are one or more differences between the current billing information and the prior billing information.

20. The non-transitory computer-readable medium of claim 17, wherein the second type of inaccuracy exists when there are one or more differences between promotional information in the current billing information and promotional information in the prior billing information.

21. The non-transitory computer-readable medium of claim 17, wherein the request includes a report identifying the second ones of the one or more inaccuracies identified as manually correctable.

22. The non-transitory computer-readable medium of claim 17, wherein the promotional information includes discounts, credits, or rate codes that apply to the current billing information.

23. The non-transitory computer-readable medium of claim 17, further comprising:

one or more instructions for receiving information about a customer or technical problem; and one or more instructions for comparing the information about the customer or technical problem to the current billing information to determine whether a fourth type of inaccuracy exists in the current billing information.

24. The non-transitory computer-readable medium of claim 17, wherein the set of rules include legal notices, taxes, payment notices, and charge notices.

* * * * *